US007154391B2

(12) United States Patent
Maki et al.

(10) Patent No.: US 7,154,391 B2
(45) Date of Patent: Dec. 26, 2006

(54) COMPACT SECURITY SENSOR SYSTEM

(75) Inventors: Melvin C. Maki, Kanata (CA); Pier Bortot, Nepean (CA)

(73) Assignee: Senstar-Stellar Corporation

( * ) Notice: Subject to any disclaimer, the term of this patent is extended or adjusted under 35 U.S.C. 154(b) by 175 days.

(21) Appl. No.: 10/627,615

(22) Filed: Jul. 28, 2003

(65) Prior Publication Data

US 2005/0024208 A1 Feb. 3, 2005

(51) Int. Cl.
*G08B 13/00* (2006.01)

(52) U.S. Cl. ..... 340/550; 340/541; 340/545.3; 340/552

(58) Field of Classification Search ..... 340/541, 340/545.3, 55 D, 552–557
See application file for complete search history.

(56) References Cited

U.S. PATENT DOCUMENTS

| | | | | | |
|---|---|---|---|---|---|
| 3,789,384 | A * | 1/1974 | Akers | 340/521 |
| 4,103,293 | A * | 7/1978 | La Forge, Jr. | 340/514 |
| 4,206,450 | A * | 6/1980 | Harden et al. | 340/577 |
| 4,209,776 | A * | 6/1980 | Frederick | 340/541 |
| 4,327,358 | A * | 4/1982 | Karas | 342/27 |
| 4,328,487 | A | 5/1982 | Cheal | 340/554 |
| 4,536,752 | A | 8/1985 | Cheal et al. | 340/554 |
| 5,001,984 | A * | 3/1991 | Jones et al. | 102/418 |
| 5,142,152 | A | 8/1992 | Boiucaner | 340/545 |
| 5,239,459 | A * | 8/1993 | Hunt et al. | 700/90 |
| 5,283,551 | A | 2/1994 | Guscott | 340/567 |
| 5,493,273 | A * | 2/1996 | Smurlo et al. | 340/541 |
| 5,517,429 | A * | 5/1996 | Harrison | 342/378 |
| 5,657,076 | A * | 8/1997 | Tapp | 348/154 |
| 5,838,238 | A * | 11/1998 | Abita et al. | 340/573.1 |
| 5,914,655 | A | 6/1999 | Clifton et al. | 340/506 |
| 5,933,082 | A * | 8/1999 | Abita et al. | 340/541 |
| 6,288,640 | B1 | 9/2001 | Gagnon | 340/539 |
| 6,323,773 | B1 * | 11/2001 | Runyon et al. | 340/573.1 |
| 6,424,259 | B1 | 7/2002 | Gagnon | 340/554 |
| 6,456,198 | B1 | 9/2002 | Kato et al. | 340/564 |
| 6,462,663 | B1 | 10/2002 | Wilson et al. | 340/573.1 |
| 6,466,157 | B1 * | 10/2002 | Bjornholt et al. | 342/28 |
| 6,717,515 | B1 * | 4/2004 | Osako et al. | 340/540 |
| 6,731,210 | B1 * | 5/2004 | Swanson et al. | 340/566 |

FOREIGN PATENT DOCUMENTS

| | | |
|---|---|---|
| EP | 0 240 466 | 10/1987 |
| GB | 2 364 809 | 6/2002 |

* cited by examiner

*Primary Examiner*—Brent A. Swarthout
(74) *Attorney, Agent, or Firm*—Shapiro Cohen

(57) ABSTRACT

A sensor array that forms part of an intrusion detection system, which is adapted for use on narrow spaced objects that surround a perimeter. The sensor array includes at least two intrusion detection sensor nodes, a plurality of node processors corresponding to each sensor node, and a deformable cable. The plurality of sensor nodes are situated and spaced along the deformable cable. The at least two sensory nodes include one or more discrete volumetric sensors with associated volumetric detection fields extending from each discrete volumetric sensor. Each sensor node has a detection zone extending transversely to the longitudinal direction of the deformable cable at the sensor node and defined by the detection fields of its constituent sensors as constructed and arranged in each sensor node. Each sensor node includes a node processor situated thereat for processing a response generated by the sensors when an intruder enters a nodes detection zone. An array processor of the sensor array can be coupled to each node processor to receive and process alarm disturbance signatures from each node processor.

21 Claims, 6 Drawing Sheets

COMPACT SECURITY SENSOR SYSTEM

FIELD OF THE INVENTION

The present invention relates to the field of intrusion detection systems, more particularly to an intrusion detection system for installation on or near to the top of a wall or a roof-edge.

DESCRIPTION OF THE PRIOR ART

Intrusion detection systems are frequently placed on fences, roofs or walls that provide the perimeter of a space to be protected. These systems detect the presence of an intruder and provide an alarm signal when an intruder approaches the boundary of the perimeter.

Several prior art systems exist for detecting the presence of an intruder who passes over or approaches a fence or a wall. For instance, U.S. Pat. No. 4,327,358, issued to Karas discloses a security area protection system that combines a physical deterrent barrier with an upward looking intrusion detection sensor. The intrusion sensor monitors the air space over the barrier, and comprises a corner reflector antenna that is mounted on top of and coextensive with the deterrent barrier, the sensor comprising a leaky transmission line that extends the length of the corner reflector antenna. While the Karas patent discloses a security protection system for use on a fence or wall-top, the leaky coaxial cable does not provide uniform detection close to metal objects such as a fence, and the system is not easily adaptable for use with irregularities or bends in a fence or wall surrounding a perimeter.

The U.S. Pat. No. 6,424,259 issued to Gagnon discloses an intruder detection system used to detect objects or people moving within the vicinity of a predetermined path or line. The path is defined by a distributed antenna, such as an open transmission line, alongside which, within a predetermined distance, is an array of discrete antennas spaced apart from each other. The distributed antenna and each discrete antenna define a detection zone path. A radio frequency transmitter is connected to one end of the distributed antenna and the array of discrete antennas. Connected to the other end of the distributed antenna and the array of discrete antennas is a receiver. According to Gagnon, a controller exchanges radio frequency energy between the distributed antenna and a selected discrete antenna within the array. The energy received from the selected discrete antenna is analysed to detect perturbations in the received radio frequency energy caused by an intruder moving near the path and adjacent the selected antenna. While the Gagnon patent teaches a linear array of discrete sensors for detecting an intruder in the vicinity of a line, such as a fence or wall, the arrangement disclosed by Gagnon with antennae typically 20 feet away from the wall or fence is not suitable for use on narrow spaced wall tops or roof edges that surround a perimeter.

U.S. Pat. No. 6,424,259 issued to Gagnon and U.S. Pat. No. 4,536,752 issued to Cheal both describe intrusion detection systems which include open transmission line sensors coupled to discrete antennas or receivers which are spaced along the transmission line. These intrusion detection systems each provide an array of sensing zones which are created by coupling a generally single radio frequency signal generated by a central transmitter or receiver from the cable onto the array of antennae. While the intrusion detection systems described by Gagnon and Cheal can be used in perimeter applications, each system has limited detection features.

Other prior art systems use microwave or IR sensors to detect the presence of an intruder along a perimeter. These systems include multiple discrete sensors or transmit/receive (tx/rx) bistatic pairs that are deployed in a basket weave manner, separated by large distances, for example up to 100 m. These systems are installed on a wall-top or roof edge that surrounds a perimeter to be protected, and detect intrusion when an intruder disturbs the detection field "beam" between the two sensor heads of the pair. Limitations to the microwave systems are caused by the long start up distance for sensor beams, requiring them to be overlapped, which makes installation on walls or fences having several bends difficult. Furthermore, because the beams of the microwave systems only follow a straight line, these systems are costly to install, as each sensor must be replicated at every bend in a wall.

This invention therefore seeks to provide an intrusion detection system that detects intruders approaching a narrow object that forms a perimeter, such as a roof edge, a top edge of a perimeter wall or a building wall. The invention also provides a system which is easily installed and maintains a continuous detection zone along the perimeter, which may be curved, or have bends both horizontally and vertically.

SUMMARY OF THE INVENTION

The present invention relates to a sensor array for an intrusion detection system. According to the present invention, the sensor array includes at least two sensor nodes, a corresponding node processor at each sensor node, and a deformable cable. Each sensor node includes one or more discrete sensors, which are classified as volumetric sensors or non-volumetric sensors. The discrete volumetric sensors each have an associated volumetric intrusion detection field extending therefrom and are constructed and arranged to generate a response to an intruder entering its detection field. Each sensor node situated and spaced along a deformable cable and has a volumetric detection zone defined by the detection fields of its constituent sensors as constructed and arranged in each sensor node. The volumetric detection zone extends transversely to the longitudinal direction of the deformable cable at the sensor node. The array processor is coupled to each node processor for generating information based on processing of the response generated from the detection zone of each sensor node. Whenever an intruder enters the detection zone of a sensor node, one or more of the discrete sensors of the sensor node generates a response representative of the presence of an intruder.

Each sensor node may further include a node processor coupled to each sensor. In this embodiment of the invention, the node processor signal processes the responses generated by the discrete sensors, and generates an alarm disturbance signature. The alarm disturbance signature is then transmitted to the array processor, which then further signal processes the alarm disturbance signature to differentiate from environmental factors such as rain or snow, or small wildlife.

The array processor may also include provisions to provide power to each of the sensor nodes from a given distribution point along the sensor array. In an embodiment of the invention, an external power source, such as a solar module or a battery/converter, may be connected to the given distribution point within the sensor array.

The sensor array of the present invention forms part of an intrusion detection system that includes a system controller and a calibration means. The system controller is coupled to the array processor and the calibration means is coupled to the system controller. The calibration means communicates with each sensor node through the system controller to adjust the sensitivity settings of the sensors of each sensor node. The system controller further processes information received from the array processor and communicates with an operator interface to provide a display map of the location of the intruder.

In an embodiment of the invention, the sensor array may be encased within an elongated housing such as an elongated duct, pipe or raceway to cause minimal visual impairment to the wall, roof top or edge. Depending on the array mounting, a detection field would normally extend upward or outward from the wall top or roof edge. In a further embodiment of the present invention, the sensor nodes may be integrated and fabricated as custom microchips, each of which may be encased within and spaced apart along a flat deformable cable or tape. In another embodiment, several linear sensor arrays may be combined end to end and distributed along a large perimeter in order to provide a large coverage length area for detecting the presence of an intruder.

In another embodiment, the sensor array may be used in an intruder detection system in conjunction with other known prior art discrete sensors that detect the presence of an intruder. By combining the sensor array with such discrete sensors, the probability that an intrusion detection system will detect the presence of an intruder increases.

The present invention is advantageous in that when the sensor array is integrated and encased within a deformable flat cable or tape, its installation on a narrow or three-dimensional surface is facilitated. The installation may be on, for example, the side or top of a building, wall, ship, dock, or fountain where an unobtrusive detection system is desired. The present invention is also advantageous in that each sensor phenomenology in a particular sensor node may be selected in order to provide different detection features, thereby enhancing the probability of detecting the presence and the location of an intruder, and differentiating a valid threat from a nuisance alarm, such as those caused by birds, small animals, . . . etc.

In a first aspect the present invention provides a sensor array forming part of an intrusion detection system and having a plurality of discrete volumetric sensors each having an associated volumetric intrusion detection field extending therefrom and constructed and ranged to generate a response to an intruder entering its detection field, the sensor array comprising:

a deformable cable;

a plurality of sensor nodes situated and spaced along the deformable cable, each sensor node having at least one discrete volumetric sensor having a detection field and at least one of the sensor nodes having at least two discrete volumetric sensors, each sensor node having a volumetric detection zone defined by the detection fields of its constituent sensors as constructed and arranged in each sensor node, the volumetric detection zone extending transversely to the longitudinal direction of the deformable cable at the sensor node; and a plurality of node processors, each corresponding to one of the plurality of sensor nodes and situated thereat, for generating information based on processing of the response generated from the detection zone of the constituent sensors.

In a second aspect the present invention provides a sensor array forming part of an intrusion detection system and having a plurality of discrete volumetric sensors each having an associated volumetric intrusion detection field extending therefrom and constructed and arranged to generate a response to an intruder entering its detection field, the sensor array comprising:

(i) a deformable cable;

(ii) a plurality of sensor nodes situated and spaced along the deformable cable, each sensor node having at least one volumetric sensor having a detection field and at least one of the sensor nodes having at least two discrete volumetric sensors, each sensor node having a volumetric detection zone defined by the detection fields of its constituent sensors as constructed and arranged in each sensor node, the volumetric detection zone extending transversely to the longitudinal direction of the deformable cable at the sensor node, and each sensor node having a node processor situated thereat for generating an alarm disturbance signature based on the response generated by each volumetric sensor of the sensor node; and (iii) an array processor for generating information based on the alarm disturbance signature received from each node processor, the array processor being coupled to the node processor of each sensor node.

In a third aspect, the present invention provides an intrusion detection system comprising:

(I) at least one sensor array having a plurality of discrete volumetric sensors each having an associated volumetric intrusion detection field extending therefrom and constructed and arranged to generate a response to an intruder entering its detection field, the system having:

(i) a deformable cable;

(ii) a plurality of sensor nodes situated and spaced along the deformable cable, each sensor node having at least one volumetric sensor having a detection field and at least one of the sensor nodes having at least two discrete volumetric sensors, each sensor node having a volumetric detection zone defined by the detection fields of its constituent sensors as constructed and arranged in each sensor node, the volumetric detection zone extending transversely to the longitudinal direction of the deformable cable at the sensor node, and each sensor node having a node processor situated thereat for generating an alarm disturbance signature based on the response generated each volumetric sensor of the sensor node; and (iii) an array processor for generating information based on the alarm disturbance signature received from each node processor, the array processor being coupled to the node processor of each sensor node;

(II) a calibration means for adjusting the sensitivity setting of each discrete sensor, and (III) a system controller for processing the information received from the array processor and for generating an alarm condition;

wherein the calibrating system is coupled to the system controller, and wherein the system controller is coupled to each sensor array.

BRIEF DESCRIPTION OF THE DRAWINGS

The present invention will now be described with reference to the drawings in which.

DETAILED DESCRIPTION OF THE INVENTION

The invention will be described for the purposes of illustration only in connection with certain embodiments; however, it is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

Figure 1:
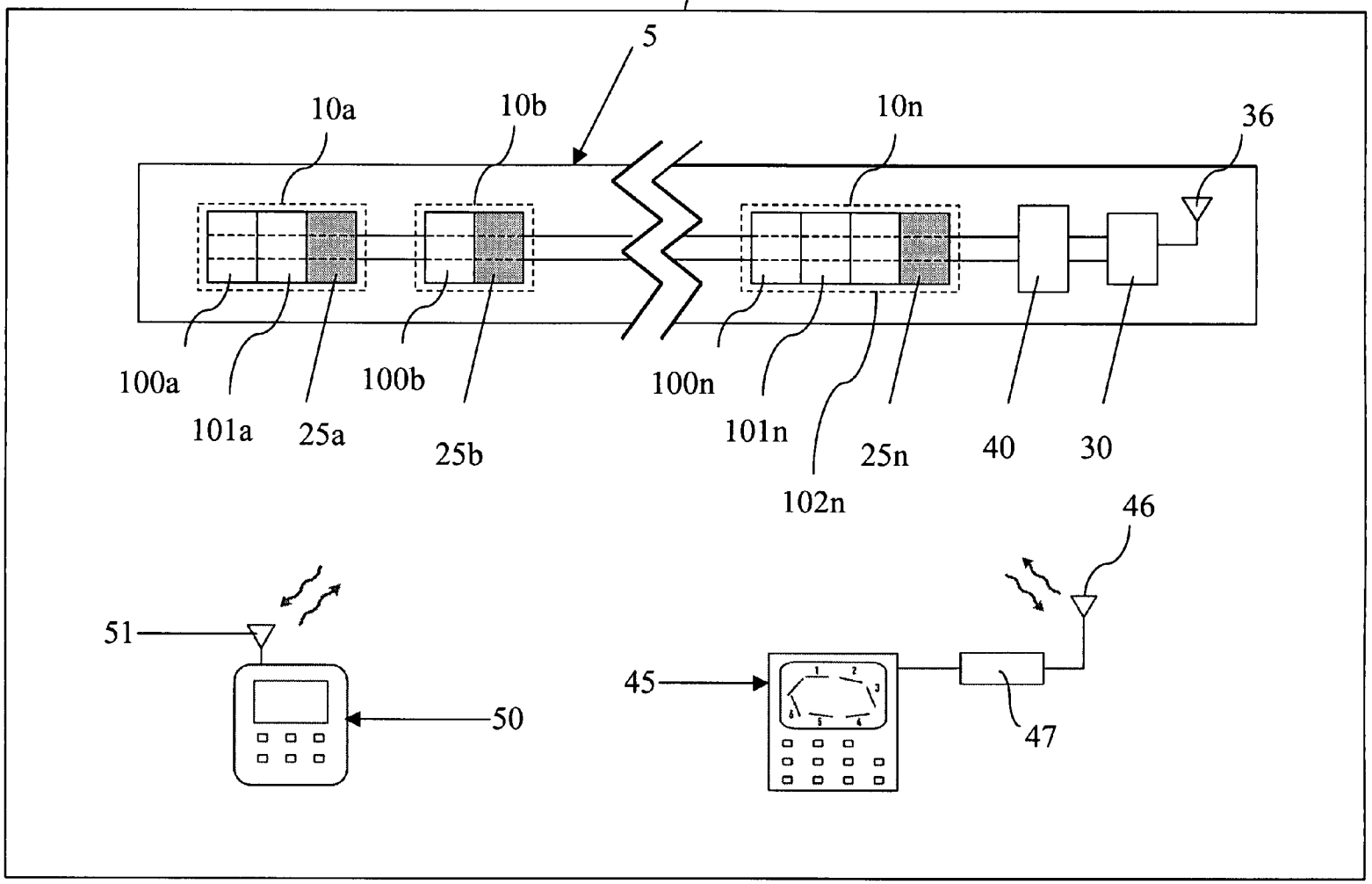
FIG. 1 is a block diagram of an intrusion detection system according to the present invention.

Referring now to FIG. 1, a block diagram of an intrusion detection system 2 of the present invention is illustrated. The intrusion detection system 2 consists of a sensor array 5, a system controller 45 and a calibration means 50. The sensor array 5 includes one or more discrete sensor nodes 10*a*, 10*b*, . . . , 10*n* and an array processor 30. Each of the discrete sensor nodes 10*a*, 10*b*, . . . , 10*n* is separated by a prescribed distance to provide an abutting or overlapping detection field with an adjacent sensor node and may contain one or more discrete sensors. In the embodiment shown in FIG. 1, sensor node 10*a* contains two discrete sensors, 100*a*, 101*a*, sensor node 10*b* contains one discrete sensor 100*b*, and sensor node 10*n* contains three discrete sensors 100*n*, 101*n*, 102*n*.

Figure 4:
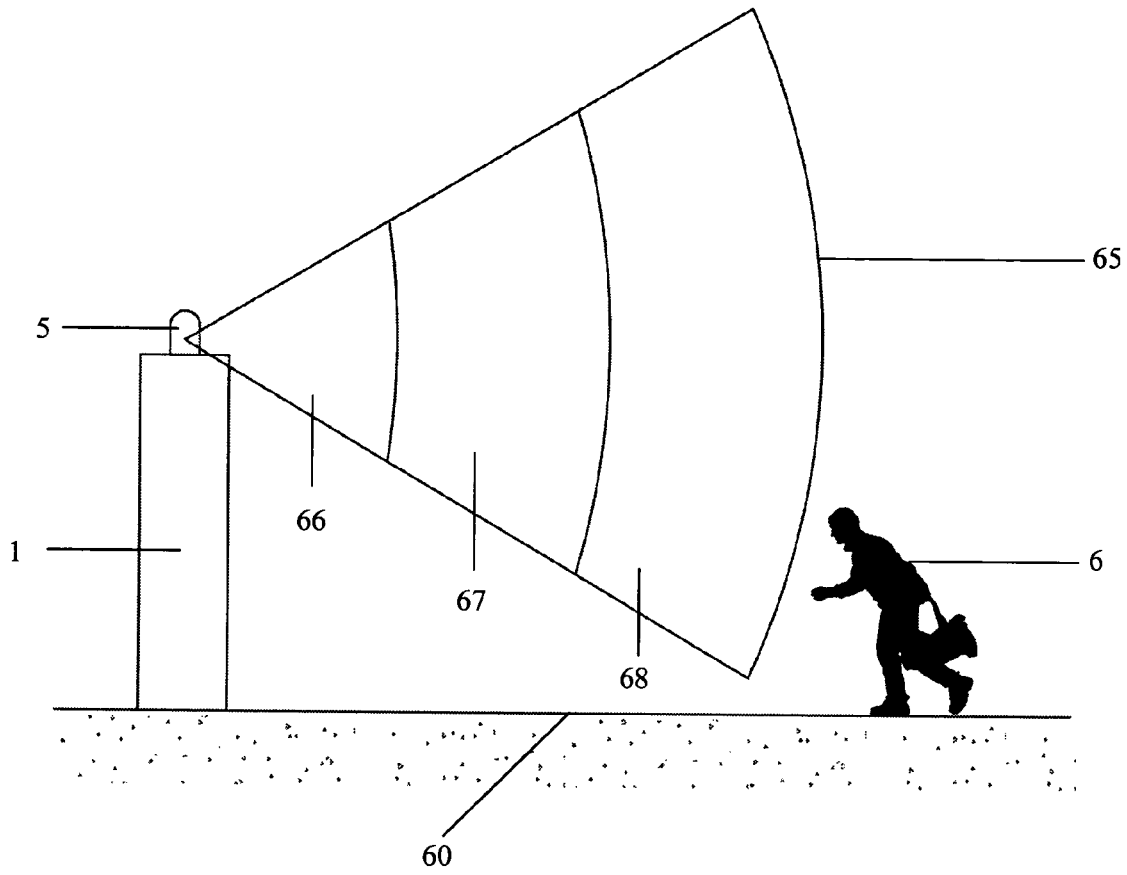
FIG. 4 is a side view of a second embodiment of the present invention mounted on top of a wall to provide a longer-range lookout.

It should be mentioned that there is no limitation on the number of discrete sensors that may be contained within a particular sensor node, nor the number of sensor nodes located within a sensor array. Furthermore, in the preferred embodiment of the invention, the distance between sensor nodes 10*a*, 10*b*, . . . ,10*n* may be selected based on several factors such as the type of intruder to be detected, the orientation of an intruder relative to the detection zone of a sensor node (where the detection zone is defined by the effective detection fields of its constituent sensors as constructed and arranged in each sensor node), the detection field of a particular discrete sensor, the range of detection of the sensor nodes, and whether the detection zones of the sensor nodes are to overlap. For example, in the embodiment of the invention in which the sensor array is mounted on a wall-top, the sensor nodes may be spaced 0.75 m apart and have detection zones that span 90 degrees in the plane transverse to each sensor node. In this embodiment, a human intruder who enters a detection zone transversely would always be detected. In the embodiment of the invention where the sensor arrays are mounted horizontally on the side of a wall, as shown in FIG. 4, to detect an intruder approaching the perimeter the sensor nodes may be spaced 20 m apart, their detection zones may extend a distance of 20 meters and their detection zones may span 90 degree in the plane transverse to each sensor node. In the embodiment of the invention where the sensor array may be mounted vertically on a wall, the sensor nodes may be spaced apart by 2.5 m. In the preferred embodiment, the sensor nodes may be spaced 0.25–20.0 meters apart.

Again, referring to FIG. 1, each sensor node 10*a*, 10*b*, . . . , 10*n* may also contain a node processor 25*a*, 25*b*, . . . , 25*n*. The sensor nodes 10*a*, 10*b* . . . , 10*n* are each connected to an array processor 30, either using digital or low frequency analog data cables or a wireless communication means (not shown). The sensor array 5 may further contain a means for providing power 40 coupled to each of the sensor nodes 10*a*, 10*b*, . . . , 10*n* and the array processor 30.

In an embodiment of the invention, the sensor array 5 may receive power from an external source such as a solar panel or battery. The external power source (not shown) would be coupled to a distribution point (not shown) within the sensor array 5, which in turn would be coupled to the array processor 30 and each sensor node 10*a*, 10*b*, . . . , 10*n*. The array processor 30 may also include a wireless transmission means 36 which is coupled to a wireless transmission means 46 of the system controller 45. The system controller 45 includes a means for providing bidirectional wireless communications 47 coupled to the wireless communication means 46. The calibration means 50 is connected via a wireless transmission means 51 to the wireless transmission means 46 of the system controller 45.

Figure 2:
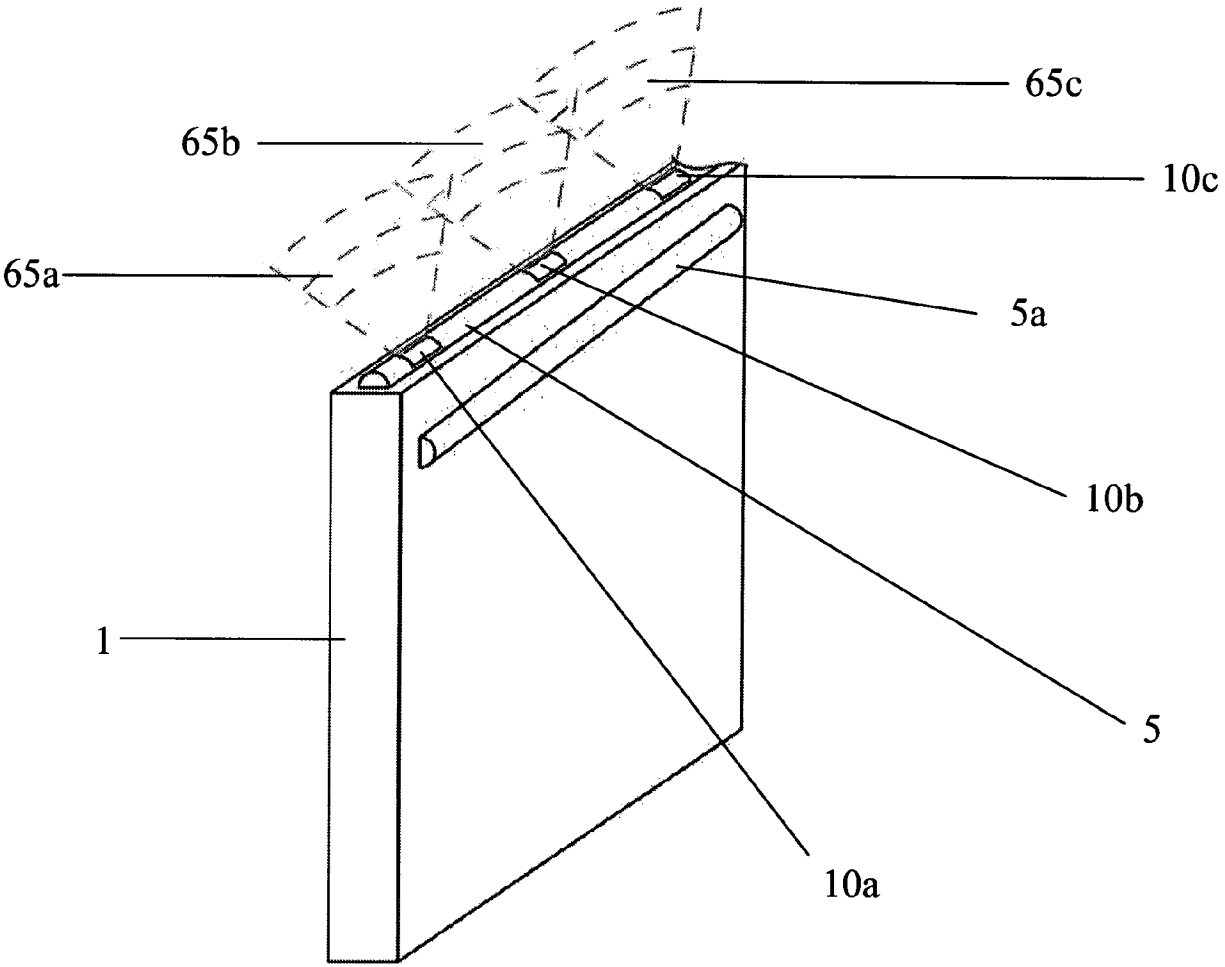
FIG. 2 shows a first embodiment of an intrusion system mounted on a wall-top along with a detection zone according to the present invention.

According to the present invention, each sensor node 10*a*, 10*b*, . . . , 10*n* has a corresponding detection zone 65*a*, 65*b*, 65*c*, shown in FIG. 2. Each detection zone 65*a*, 65*b*, 65*c* extends transversely to a longitudinal axis of each sensor node 10*a*, 10*b*, . . . , 10*n*. As an intruder (not shown) approaches a detection zone 65*a*, 65*b*, 65*c* of the sensor array 5, the discrete sensors 100*a*, 100*b*, . . . , 100*n* of the sensor node 10*a*, 10*b*, . . . , 10*n* of FIG. 1, detect the presence of the intruder and generate a response to the presence of an intruder in the detection zone 65*a*, 65*b*, 65*c*. The response signal generated by a given sensor depends on the sensor phenomenology. For example, if the discrete sensor is a doppler microwave module that accepts a 5V d.c. input, the response signal generated by the discrete sensor operating as a monostatic radar is a voltage with a frequency proportional to the velocity of an object within its detection field. If the discrete sensor is a pulsed ultrasonic sonar sensor, the response signal generated from the reflection from the target includes the range of an intruder.

It should be noted that in the embodiment of the invention where the sensor nodes 10*a*, 10*b*, . . . , 10*n* each include a plurality of discrete sensors 100*a*, 100*b*, . . . , 100*n*, each of the detection zones 65*a*, 65*b*, 65*c* are comprised of one or more detection fields (not shown). Accordingly, the detection zone 65*a* has a subset of detection fields (not shown) for each discrete sensor 100*a*, 101*a*, . . . , the detection zone 65*b* has a subset of detection fields (not shown) for each discrete sensor 100*b*, 101*b*, . . . , the detection zone 65*c* has a subset of detection fields (not shown) for each discrete sensor 100*c*, 101*c*, . . . ,. For example, if discrete sensor 100*a* is a microwave doppler which senses to a distance of 1 m and discrete sensor 101*a* is an ultrasonic sensor which senses to a distance of 2 m, then a sequential response from each discrete sensor 100*a*, 101*a* is needed for a valid alarm.

Again referring to FIG. 1, once a given discrete sensor 100*a*, 100*b*, . . . , 100*n* generates a response signal, the corresponding node processor 25*a*, 25*b*, . . . , 25*n* processes the response signal to generate an alarm disturbance signature. Processing of the response signal may include amplification, bandpass filtering, digitization and comparison of the response signal to a threshold or to the response from the other sensors in the node. Thus, the alarm disturbance signature may be a time array of filtered sampled data. Once the alarm disturbance signature is generated, the node processor 25*a*, 25*b*, . . . , 25*n* transmits the signature, along with other sensor data, such as the address of the sensor node, to the array processor 30. It should be noted that in the case the sensor node includes discrete sensors with different phenomenologies, the node processor signal processes each response and generates an alarm disturbance signature based on the processed responses. It should be further noted that the node processors and the array processor may be connected in a wired or wireless manner and communication to and from each device may be done using a protocol known to the skilled artisan such as Inter-Integrated Circuit ($I^2C$) Device Network protocol, 1 wire™, or Universal Serial Bus (USB).

The array processor 30 receives the alarm disturbance signatures from each node processor 25*a*, 25*b*, . . . , 25*n* and signal processes the signatures in order to classify the intruder which has entered a detection zone 65*a*, 65*b*, 65*c* of FIG. 2. For example, the sensor nodes 10*a*, 10*b*, . . . , 10*n*, may be spaced apart by 0.75 m with upward detection zone range for a human of 1.5 m and detection zones 65*a*, 65*b*, 65*c* abutting. If a human target passes adjacent to the sensor array 5, dependent on their human body orientation, they may span at least two of the detection zones 65*a*, 65*b*, 65*c*, whereas an intruder such as a bird may only span one of the detection zones 65*a*, 65*b*, 65*c*. The array processor 30, by knowing the time response of the intruder from the node processors, may determine if the intruder is a valid human intruder and the location of the intruder among the detection zones 65*a*, 65*b*, 65*c* of the sensor nodes 25*a*, 25*b*, . . . , 25*n*. Once the array processor 30 classifies the intruder and determines its location, it transmits the information to the system controller 45 using a known wireless communication protocol via the sensor array wireless communication means 36 and the system controller wireless communication means 45.

It should be noted that in the embodiment of the invention which includes each sensor node 10*a*, 10*b*, . . . , 10*n* being directly connected to the array processor 30, the array processor 30 performs all the functions of the individual node processors 25*a*, 25*b*, . . . 25*n* and the functions of the array processor 30 described above. Furthermore, it should be noted that the sensor array 5 may be mounted on the side of the wall 1, as shown by 5*a* in FIG. 2.

It would be apparent to one skilled in the art that any commercially available wireless communication means, such as, but not limited to RF or IR, may be used for bidirectional communication between the array processor 30 and the system controller 45 or the calibration means 50 and the array processor 30. It would further be apparent that the array processor 30 may be hardwired to the system controller 45 using a commercially available cable such as, but not limited to, a ribbon cable, twisted-pair cable or a coaxial cable.

Again, with reference to FIG. 1, the system controller 45 receives the information from the sensor array 5 and makes a determination of validity of processed responses generated by the sensors 100*a*, 100*b*, . . . , 100*n* and decides whether to declare an alarm condition. The system controller 45 also provides adaptive data back to the sensor array 5. For example, the system controller 45 can determine if the noise level is rising on all sensor arrays due to heavy rain and decide to raise thresholds of the discrete sensors 100*a*, 101*a*, . . . , or modify filtering parameters in the node processors 25*a*, 25*b*, . . . , 25*n*. The revised threshold data would be communicated to the array processor 30 or the node processors 25*a*, 25*b*, . . . , 25*n*, as described in U.S. Pat. No. 5,914,655. The system controller 45 may also store the security system or sensor array data such as thresholds. For example, if a sensor array 5 has to be replaced, then the calibration settings could be downloaded to a new sensor array. The system controller 45 further displays the alarm locations, related intrusion information or maintenance data on a display subsystem (not shown).

The calibration means 50 sets the thresholds or the filter parameters corresponding to each sensor nodes 10*a*, 10*b*, . . . , 10*n* detection zone 65*a*, 65*b*, 65*c*. For example, several test intrusions may be made through the detection zone 65, 65*b*, 65*c* of each sensor node 10*a*, 10*b*, . . . , 10*n*. The sensor nodes thresholds may be set or adjusted through a user interface, based on the results of the test intrusions, to produce a detection zone which extends out to a particular range. The parameters may be downloaded to the system controller 45, the node processors 25*a*, 25*b*, . . . , 25*n* and the array processors 30, and utilized in the signal processing of the responses and alarm disturbance signatures.

According to an embodiment of the present invention, the sensor, for example 100*a*, 101*a* of FIG. 1, may be commercially available discrete sensors or modules selected for their detection properties. For example, the discrete sensors, may be microwave modules such as microwave doppler modules or transceivers, stereo doppler modules, FM doppler radar modules, or VCO modules. The discrete sensors may also be ultrasonic, transducers such as pulsed or continuous transducers that provide range or doppler signals, or the discrete sensors may be passive infrared (IR) sensors, or active (reflective) IR sensors. In addition, the various types of discrete sensors 100*a*, 101*a*, . . . , may be combined within any sensor node 10*a*, 10*b*, . . . 10*n*. The discrete sensors are selected for their phenomenology and specific detection features, such as detection field size, shape, and parameter. For the purposes of this document, discrete sensors are classified as either being volumetric sensors or nonvolumetric sensors. Volumetric sensors are defined as each having an associated volumetric detection field. This is in contrast to non-volumetric sensors which are defined as having linear or planar detection fields, The combination of various types of discrete sensors provides each sensor node with different detection features. For example, a fixed frequency doppler microwave which provides intruder magnitude and velocity response may be combined with a pulsed ultrasonic transducer which can provide intruder range. Such a doppler microwave, by itself, is not capable of differentiating between a large intruder far away from the perimeter under surveillance and a small intruder close to the perimeter, such as a bird landing. Therefore, the addition of a second discrete sensor with a different phenomenology, such as a pulsed ultrasonic sensor, gives the intruder range information as well as assisting in intruder classification. The combination of discrete sensor phenomenologies to assess target features, and processing the signatures from each node of the sensor array, facilitates the differentiation between nuisance sources and the environment.

Furthermore, discrete sensors may be selected to have co-located field patterns, or mutually exclusive parameters for use in fusing their outputs in processing to best determine the presence of a valid target, and eliminating nuisance and environmentally produced alarms. The discrete sensors may also be selected or their fields oriented for compatibility, for example non-interference of microwave sensors. A sensor node may be designed to produce a substantially transverse detection zone that abuts or overlaps the detection zone of an adjacent sensor node. These detection zones may also be spaced apart from each other in azimuth, elevation or range in order to provide a sequential detection zone along the sensor array.

It should be noted that the array processor 30 may be positioned anywhere along the sensor array 5. The position of the array processor 30 depends on whether the sensor nodes 10*a*, 10*b*, . . . , 10*n*, and the array processor 30 are connected wired or wirelessly. When the sensor nodes 10*a*, 10*b*, . . . , 10*n* are connected wirelessly, the position will be selected based on a line of sight between the wireless communication means (not shown) of the node processors 25*a*, 25*b*, . . . , 25*n*. In contrast, when the sensor nodes 10*a*, 10*b*, . . . , 10*n* are wired to the array processor 30, the position of the array processor 30 depends on the signal loss of the wires selected. Furthermore, the position of the array processor 30 may be selected in order to minimize crosstalk, in either the wireless or wired applications between signals being transmitted from each sensor node 10*a*, 10*b*, . . . , 10*n*. The position of the sensor array 5 may also be selected for line of sight between the array processor 30 and the system controller 45.

Figure 3:
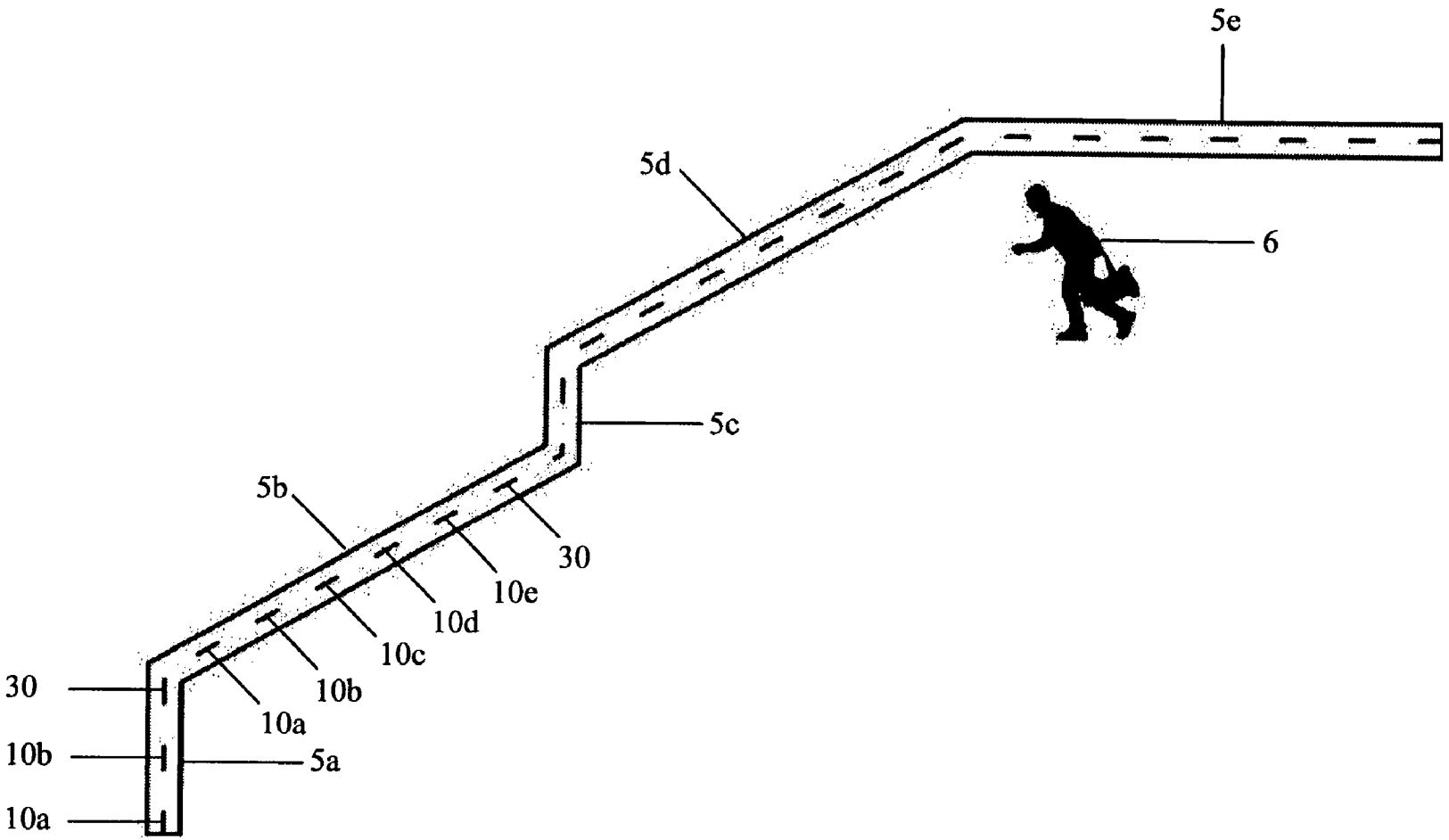
FIG. 3 is a top view of several sensor arrays connected together in sections along a series of wall or roof edges according to the present invention.

FIG. 3 shows a top-view of an embodiment of the present invention where five sensor arrays, 5*a*, 5*b*, 5*c*, 5*d*, 5*e* each of which are similar to the sensor array 5 of FIG. 1, are installed on a surface surrounding a perimeter that contains several changes in direction. It should be noted that no limitation exists in the number of sensor arrays 5 that may be connected together. Furthermore, it should be noted that in an embodiment of the invention, the sensor arrays 5 may be flexible and may bend around the corners of a perimeter. Each sensor array 5*a*, 5*b*, 5*c*, 5*d*, 5*e*, contains a varying number of sensor nodes 10*a*, 10*b*, . . . , 10*n* and an array processor 30. The combining of several sensor arrays 5*a*, 5*b*, 5*c*, 5*d*, 5*e*, facilitates the installation of an intrusion detection system 2 of FIG. 1 along a non-uniform surface. Furthermore, the linear combination of several sensor arrays enlarges the detection zone (not shown) length coverage (see figure) of the intrusion detection system 2 of FIG. 1. The sensor arrays 5*a*, 5*b*, 5*c*, 5*d*, 5*e* are placed end to end at varying angles to provide complete coverage of a perimeter. The number of sensor nodes 10*a*, 10*b*, . . . , 10*n* selected for a particular sensor array 5*a*, may be chosen on economic grounds to best match the user's needs. For example, a pre-fabricated sensor array may include four sensor nodes that are spaced apart to obtain an array length of 3 m. In an embodiment of the invention, sensor arrays 5*a*, 5*b*, 5*c*, 5*d*, 5*e* may be placed end to end to provide complete coverage of a perimeter. The arrays may be located to provide an alarm signal for directing video assessment of the appropriate part of the perimeter, for example by starting or stopping an array at a corner of the perimeter to constitute a physical zone boundary. Alternatively, the zoning of the perimeter may be done electronically using the system controller 45, and the display subsystem (not shown) may show the fixed video camera view for alarms from the sensor nodes in its specific field of view. For example, if the perimeter to be covered contains four sides, one or more arrays may be placed on each side of the perimeter in combination with a camera. In this embodiment, the cameras may each point along one side of the perimeter. When an alarm is generated by the system due to an intruder approaching one side of the perimeter, the system controller displays the image seen by the camera pointing along the array which sensed the intruder on the display subsystem. In another embodiment, each sensor node of each array may be mapped to a camera pointing along each array, so that when an alarm is generated by the system, the image of the camera pointing along the array which is mapped to the node which sensed the intruder would be displayed on the display subsystem.

Referring to FIG. 4, the sensor array 5 shown in FIG. 1 is shown installed on a wall 1 as an early warning detection system. The sensor array 5 produces a detection zone 65 that extends horizontally from the perimeter upon which the sensor array 5 is installed. In this embodiment, the sensor array 5 may be used as an early warning "look out" sensor for detecting an intruder 6 approaching a perimeter to be secured. Depending on the type of sensor chosen, the range of the sensor array 5 can be adjusted to provide detection of an intruder 6 at a distance of up to 20 m approximately from the sensor array. Using the appropriate ranging sensors, the range of the detection zone 65 may also be divided into range zones, as shown by 66, 67, 68 in FIG. 4. The range of the detection zone 65 is limited by the signal to noise ratio and operating or spectrum licensable power considerations of the specific discrete sensor.

Figure 5:
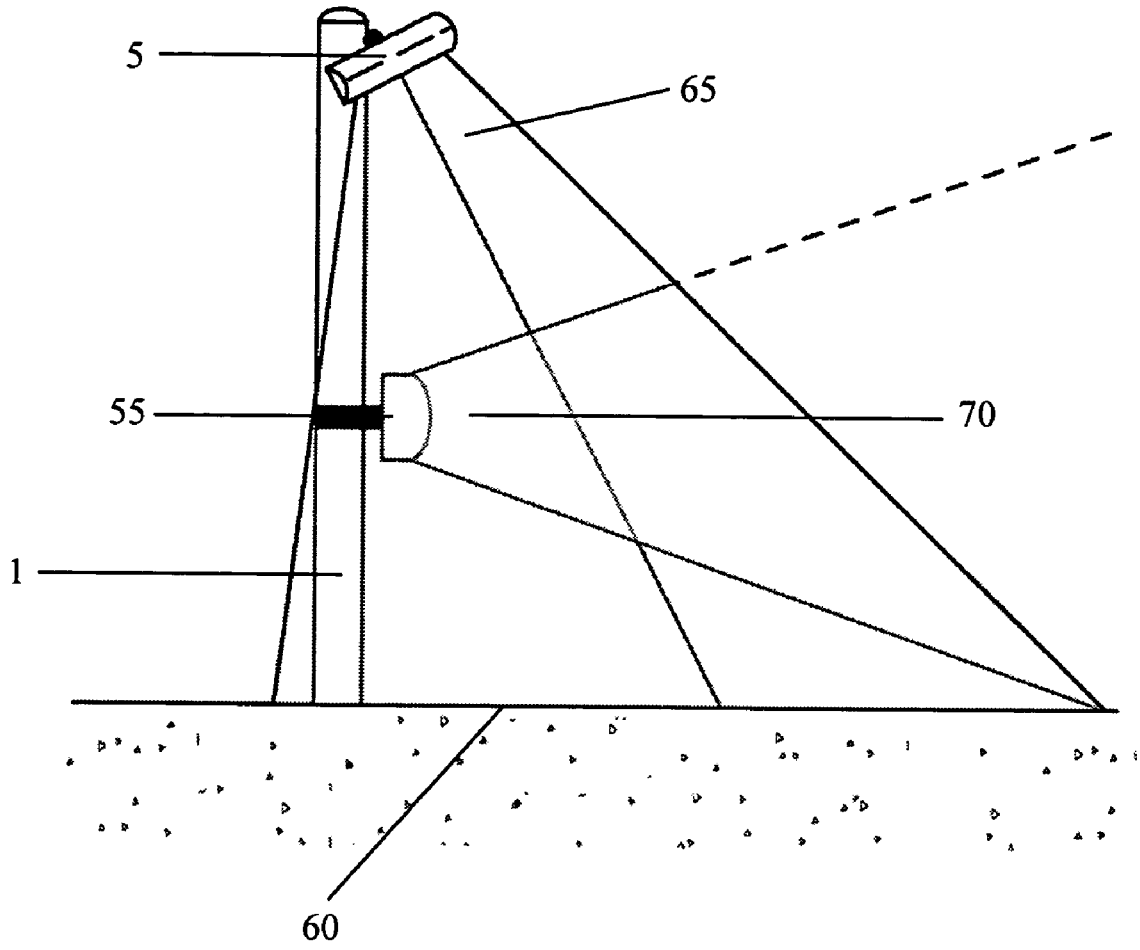
FIG. 5 is a side view of a third embodiment of the present invention mounted on the side of a wall or top of a post to provide coverage of a local detection gap.

Referring to FIG. 5, an embodiment of the invention is shown where a single or several sensor arrays 5 are installed on the top or side of a wall 1. It should be noted that the sensor array of this embodiment may also be installed on the top or side of a post. There is also shown a side sectional view of one sensor head of a plurality of commercially available security sensors 55. The sensor array 5 is utilized in conjunction with the commercially available security sensors 55 such as monostatic or bistatic microwaves. In FIG. 5, the sensor array 5 detection zone 65 is used to close the triangular gaps above and below the detection zone 70 of the sensors 55 to the ground 60, which results at and near the sensor heads of the commercially available security sensors 55 where their detection fields are most narrow. This combination provides a continuous detection zone that is difficult to penetrate without being detected, and substantially reduces the deficiencies of commercially available security sensors. The sensor array may also be utilized in conjunction with commercially available bistatic microwaves to cover gaps in the perimeter that occur when the bistatic microwaves are placed end to end along a perimeter. Whereas the bistatic microwave sensors are normally offset in a basketweave pattern to provide a continuous detection zone, the utilization of the sensor array in combination with bistatic microwave sensors removes the requirement to offset the bistatic sensors to obtain continuous coverage of the perimeter.

It should also be mentioned that the sensor array may be utilized in conjunction with a plurality of commercially available security sensors to economically cover detection gaps.

Figure 6:
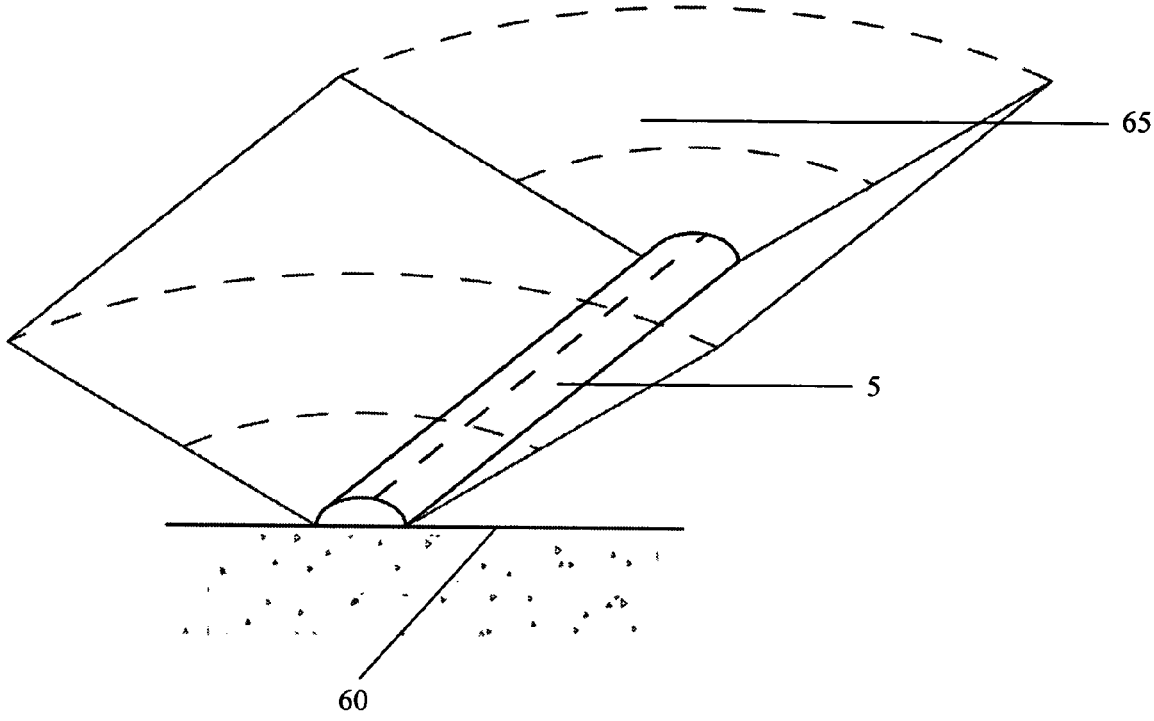
FIG. 6 is a top view of a fourth embodiment of the present invention mounted on a ground surface.

FIG. 6 illustrates another embodiment of the present invention. The sensor array 5 shown is placed on the ground 60 and it detects the presence of an object that passes through the detection zone 65 above the sensor node. The sensor array 5 may be encased within and spaced along a deformable flat cable (not shown) that makes its installation along the ground 60 simpler. Furthermore, the cable may be made of rigid material that will not break when heavy equipment (not shown), such as a truck (not shown) passes over the top of the sensor array 5. The cable may also be camouflaged such that the sensor array 5 is not easily detectable when it is placed on the ground, at or near a perimeter that is to be protected.

It should be understood that the preferred embodiments mentioned here are merely illustrative of the present invention. Numerous variations in design and use of the present invention may be contemplated in view of the following claims without straying from the intended scope and field of the invention herein disclosed.

The invention claimed is:

1. A sensor array forming part of an intrusion detection system and having a plurality of discrete volumetric sensors each having an associated volumetric intrusion detection field extending therefrom and constructed and arranged to generate a response to an intruder entering its detection field, the sensor array comprising:

a deformable cable;

a plurality of sensor nodes situated and spaced along the deformable cable, each sensor node having at least one discrete volumetric sensor having a detection field and at least one of the sensor nodes having at least two discrete volumetric sensors, each sensor node having a volumetric detection zone defined by the detection fields of its constituent sensors as constructed and arranged in each sensor node, the volumetric detection zone extending transversely to the longitudinal direction of the deformable cable at the sensor node; and a plurality of node processors, each corresponding to one of the plurality of sensor nodes and situated thereat, for generating information based on processing of the response generated from the detection zone of the constituent sensors.

2. The sensor array according to claim 1, wherein each discrete volumetric sensor is selected from at least one member of the group consisting of: microwave modules, ultrasonic transducers, passive IR sensors, and active reflective IR sensors.

3. The sensor array according to claim 1, wherein the sensor array includes a distribution point for connecting a means for providing power, the distribution point being coupled to the node processor of each sensor node.

4. The sensor array according to claim 1, wherein each sensor node is encased within and spaced along the deformable cable.

5. The sensor array according to claim 1, wherein the sensor array is encased within an elongate housing.

6. The sensor array according to claim 1, wherein each sensor node is formed as an integrated circuit.

7. The sensor array according to claim 1, wherein at least two of the detection zones overlap.

8. The sensor array according to claim 1, wherein at least two of the detection zones abut.

9. The sensor array according to claim 1, wherein adjacent sensor nodes of the plurality of sensor nodes are spaced apart along the sensor array, and wherein the space between adjacent sensor nodes has a predetermined range based upon a span of each detection zone.

10. The sensor array according to claim 1, wherein adjacent sensor nodes of the plurality of sensor nodes are spaced apart along the sensor array, and wherein the space between adjacent sensor nodes has a predetermined range based upon a distance to be detected.

11. The sensor array according to claim 1, wherein adjacent sensor nodes of the plurality of sensor nodes are spaced apart along the sensor array, and wherein the space between adjacent sensor nodes has a range of 0.25–20.0 meters.

12. A sensor array forming part of an intrusion detection system and having a plurality of discrete volumetric sensors each having an associated volumetric intrusion detection field extending therefrom and constructed and arranged to generate a response to an intruder entering its detection field, the sensor array comprising:

(i) a deformable cable;

(ii) a plurality of sensor nodes situated and spaced along the deformable cable, each sensor node having at least one volumetric sensor having a detection field and at least one of the sensor nodes having at least two discrete volumetric sensors, each sensor node having a volumetric detection zone defined by the detection fields of its constituent sensors as constructed and arranged in each sensor node, the volumetric detection zone extending transversely to the longitudinal direction of the deformable cable at the sensor node, and each sensor node having a node processor situated thereat for generating an alarm disturbance signature based on the response generated by each volumetric sensor of the sensor node; and (iii) an array processor for generating information based on the alarm disturbance signature received from each node processor, the array processor being coupled to the node processor of each sensor node.

13. The sensor array according to claim 12, wherein each discrete volumetric sensor is selected from at least one member of the group consisting of: microwave modules, ultrasonic transducers, passive IR sensors, and active reflective IR sensors.

14. An intrusion detection system comprising:

(I) at least one sensor array having a plurality of discrete volumetric sensors each having an associated volumetric intrusion detection field extending therefrom and constructed and arranged to generate a response to an intruder entering its detection field, the system having:

(i) a deformable cable;

(ii) a plurality of sensor nodes situated and spaced along the deformable cable, each sensor node having at least one discrete volumetric sensor having a detection field and at least one of the sensor nodes having at least two volumetric sensors, each sensor node having a volumetric detection zone defined by the detection fields of its constituent sensors as constructed and arranged in each sensor node, the volumetric detection zone extending transversely to the longitudinal direction of the deformable cable at the sensor node, and each sensor node having a node processor situated thereat for generating an alarm disturbance signature based on the response generated each volumetric sensor of the sensor node; and (iii) an array processor for generating information based on the alarm disturbance signature received from each node processor, the array processor being coupled to the node processor of each sensor node;

(II) a calibration means for adjusting the sensitivity setting of each discrete sensor, and (III) a system controller for processing the information received from the array processor and for generating an alarm condition;

wherein the calibrating system is coupled to the system controller, and wherein the system controller is coupled to each sensor array.

15. An intrusion detection system according to claim 14, wherein each discrete volumetric sensor is selected from at least one member of the group consisting of microwave modules, ultrasonic transducers, passive IR sensors, and active reflective IR sensors.

16. The sensor array according to claim 1, wherein adjacent sensor nodes are spaced apart based on at least one criterion selected from the group consisting of: discrete sensor phenomenology, discrete sensor detection features, intruder type, intruder orientation, detection zones of the adjacent sensor node, and range of detection zones of the adjacent sensor nodes.

17. The sensor array according to claim 12, wherein adjacent sensor nodes are spaced apart based on at least one criterion selected from the group consisting of: discrete sensor phenomenology, discrete sensor detection features, intruder type, intruder orientation, detection zones of the adjacent sensor node, and range of detection zones of the adjacent sensor nodes.

18. The intrusion detection system according to claim 14, wherein adjacent sensor nodes are spaced apart based on at least one criterion selected from the group consisting of: discrete sensor phenomenology, discrete sensor detection features, intruder type, intruder orientation, detection zones of the adjacent sensor node, and range of detection zones of the adjacent sensor nodes.

19. The sensor array according to claim 1, wherein at least one of the sensor nodes has a discrete non-volumetric sensor.

20. The sensor array according to claim 12, wherein at least one of the sensor nodes has a discrete non-volumetric sensor.

21. The sensor array according to claim 14, wherein at least one of the sensor nodes has a discrete non-volumetric sensor.

* * * * *